United States Patent [19]

Tharp

[11] Patent Number: 4,611,667

[45] Date of Patent: Sep. 16, 1986

[54] RECIPROCATING BULLDOZER BLADE

[76] Inventor: Emery C. Tharp, 468-B Costa Mesa Dr., Greenwood, Ind. 46142

[21] Appl. No.: 315,755

[22] Filed: Oct. 28, 1981

[51] Int. Cl.[4] ..... A01B 35/00

[52] U.S. Cl. ..... 172/40; 172/816; 37/DIG. 18

[58] Field of Search ..... 172/40, 816, 500; 37/DIG. 18

[56] References Cited

U.S. PATENT DOCUMENTS

| | | | |
|---|---|---|---|
| Re. 20,663 | 3/1938 | Cameron | 172/40 |
| 954,758 | 4/1910 | Naylor | 172/500 |
| 1,632,345 | 6/1927 | Muelhause | 172/500 X |
| 3,410,352 | 11/1968 | Tharp | 172/40 |
| 3,628,265 | 12/1971 | Galis | 37/DIG. 18 X |
| 3,762,481 | 10/1973 | Allen et al. | 172/40 |
| 3,867,987 | 2/1975 | Seaberg | 172/40 |
| 3,952,810 | 4/1976 | Ulrich | 172/40 |
| 4,102,402 | 7/1978 | Steinberg | 172/40 |

*Primary Examiner*—Paul E. Shapiro

*Attorney, Agent, or Firm*—Leonard Bloom

[57] ABSTRACT

A reciprocating type of bulldozer blade which blade is mounted on a telescoping member for telescoping engagement with a support arm carried on the bulldozer proper, the improvement including a flywheel disposed on a powered shaft which is rotated, the rotating powered shaft operatively connected to a bulldozer blade through a cam system to provide reciprocal movement of the blade in response to powered shaft rotation. The flywheel provides a more uniform shaft rotation and therefore a greater force on the bulldozer blade as it cycles back and forth. In addition, the relatively telescoping support parts for the blade have provided thereon a supporting instrumentality connected to a stationary portion of the telescoping assembly, and a cylinder having a spring device on the moving reciprocatory part, a shaft extending therebetween so that in combination with the flywheel, additional force is provided on the bulldozer blade by cyclically loading and unloading the spring, which works against the shaft.

1 Claim, 2 Drawing Figures

RECIPROCATING BULLDOZER BLADE

BACKGROUND OF THE INVENTION

Figure 1:
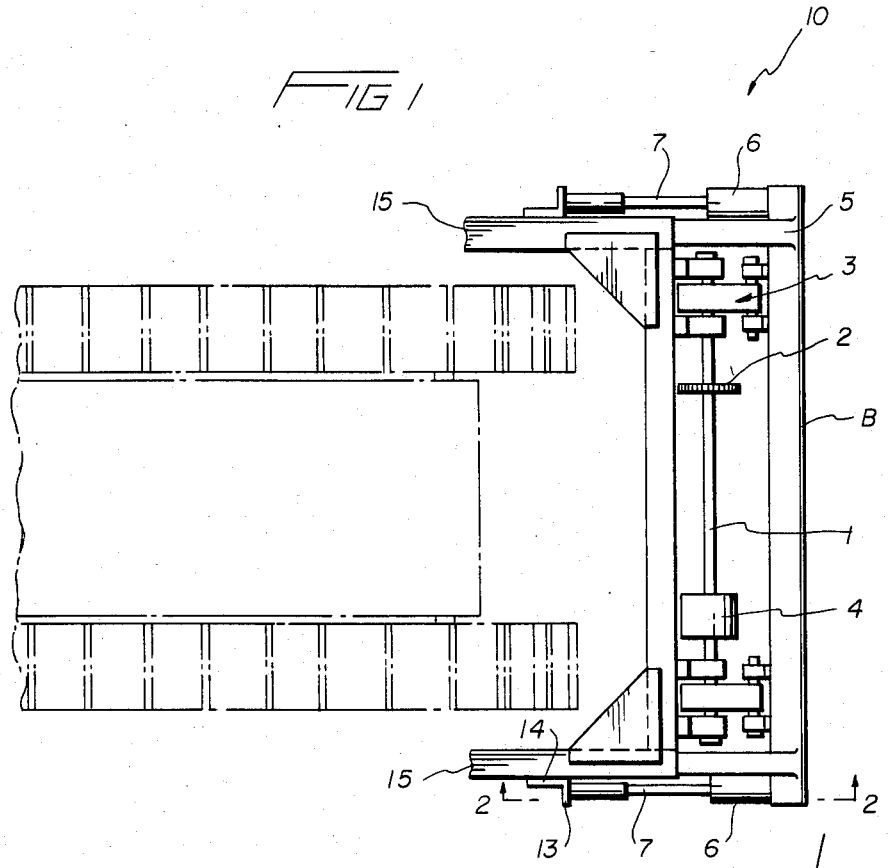

This invention relates generally to improvements in reciprocating bulldozer blades. More specifically, the invention relates to an improvement in may U.S. Pat. No. 3,410,352, Nov. 12, 1968.

While the reciprocating bulldozer blade disclosed in my earlier patent provided a device which is capable of outperforming substantially heavier bulldozers used especially in removing pavement, wall structures, dirt and the like, by virtue of the reciprocatory action. The following teaches and provides for a new and novel device for even further increasing the ability of a bulldozer so equipped over even larger types of bulldozers.

It is well known that the bulldozer's ability to work efficiently has alway been limited by the amount of traction capable of being transferred to the tractor treads, a phenomena directed related to the weight of the machine. As pointed out earlier, use of a reciprocatory blade provides an intermittent pulsing of the blade on the object worked on, the net effect being a smaller bulldozer having the performance characteristics of a substantially larger one. The improvements disclosed hereinafter provide an even greater advantage in allowing a bulldozer so equipped to perform the work of a larger one.

The following patents reflect the state of the art in which applicant is aware in so far as the patents appear to be germane to the patent process:

U.S. Pat. No. 3,762,481 Allen et al.

U.S. Pat. No. 3,410,352 Tharp

U.S. Pat. No. 3,867,987 Seaberg

None of these references teach nor render obvious the new and novel combination of elements as set forth hereinafter, which as will be disclosed includes a support arm having a telescoping member slidably disposed therewithin, a means for support on the support arm fixedly attached to a shaft, the shaft communicating with a housing having a spring therein, the housing formed as a cylinder and carried on the telescoping member of the bulldozer, the telescoping member supporting a bulldozer blade. A flywheel is provided on a means for driving a cam section which provides the reciprocatory motion of the blade.

SUMMARY AND OBJECTS OF THE INVENTION

Accordingly, this invention has as an objective to provide a new and novel vibratory bulldozer blade which provides an increased vibration force over prior art devices thereby providing a bulldozer capable of doing substantially more work than would prior art devices of the same dimension.

It is a further object of this invention to provide a new and novel device of the character described above further including an improved force administering device to increase the efficiency of the bulldozer.

It is still yet a further object of this invention to provide a device of the character described above which is extremely durable in construction, reliable in use, and readily installable on prior art type bulldozers.

It is yet a further object of the invention to provide a device of the character described above which lends itself to mass production techniques.

These and other objects will be made manifest when considering the following detailed specification when taken in conjunction with the appended drawing figures.

BRIEF DESCRIPTION OF THE DRAWING FIGURES

Figure 2:
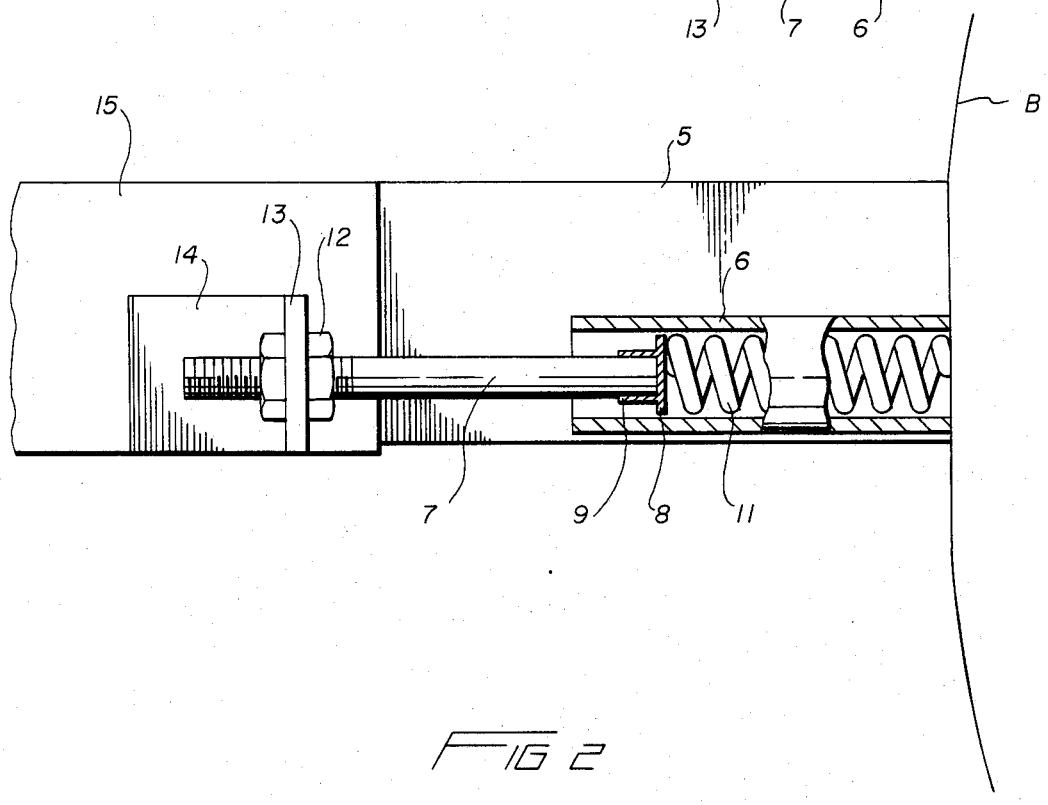

FIG. 1 is a top plan view of the apparatus according to the present invention; and FIG. 2 is a sectional view taken along lines 2—2 of FIG. 1.

BRIEF DESCRIPTION OF THE PREFERRED EMBODIMENT

Referring to the drawings now, wherein like references numerals refer to like parts throughout the various drawing figures, reference numeral 10 is directed to the improvement on a reciprocating bulldozer blade according to the present invention. Components which are common to the inventor's earlier U.S. Pat. No. 3,410,352 will not be discussed at this time, and reference to said patent is incorporated herewith.

As shown in the drawings, the bulldozer blade B is capable of reciprocating motion by means of its operative connection through a telescoping member 5 slidably disposed within a hollow of a support arm 15 as best shown in FIGS. 1 and 2. A cam member 3 extends between the support arm 15 and the blade B, the cam 3 drivingly engaged by a powered shaft 1 through a sprocket 2 as is well known. The rotation of the shaft 1 causes the blade to reciprocate in a horizontal plane, and the eccentric nature of the cam along with its associated high and low spots provide pulses and inertial moments which define durations in which the bulldozer blade is most likely to meet with the greatest resistance with the dirt or work engaging the bulldozer. That is the acceleration and deceleration from the cyclic action of the cam provides points at the extremities of the stroke of the cam in which the momentum is substantially zero. Obviously therefore at this point, it is most likely that the bulldozer's capability of doing work can be deterred by the reaction against the object the bulldozer B is encountering. Thus, a flywheel 4 of substantially cylindrical configuration (so as to not create any imbalances in the power shaft) is suitably disposed on the shaft 1 to provide further impetus and momentum for the shaft to continue its rotation beyond the high and low points of the cam activity.

A portion of the momentum generated by the flywheel 4 is directed to a second improvement according to the invention for vibrating blades in which means for support is connected to the support arm 15, the means for support defined by an "L" shaped bracket fixedly secured to the support arm 15 as shown in FIGS. 1 and 2. A shaft is affixed to the outstanding leg 13 of the "L" shaped bracket, another leg 14 being tangentially disposed and affixed to the support arm 15 for secure purposes, the shaft 7 threadedly connected to the outstanding leg portion 13 through a hole as shown.

Attached to the telescoping member 5 there is a cylinder 6 fixedly secured thereto axially oriented to allow the shaft 7 to reciprocate therein sychronized with the action by the cam 3, and the shaft as shown in FIG. 2 is adapted to work against a spring 11 slidably disposed within the cylinder bore. In order to increase the contact area of the shaft 7 against the spring 11, a cap member is placed on the shaft's terminus remote from the "L" shaped bracket. More specifically, a sleeve 9 is frictionally disposed about the shaft terminus, the sleeve 9 including an end wall 8 dimensioned substantially that of the inner diameter of the cylinder 6 so that horizontal reciprocal motion of the telescoping member serves to compress the spring 11 based on its reaction against the cap member wall 8.

Thus, a portion of the energy associated with the flywheel is diverted into compressing the spring, the orientation of the spring, cylinder, and shaft is such that when the cam is at the top of a stroke and about to provide a pulse to the right as shown in FIG. 2, the spring is allowed to expand so as to increase the amount of force the bulldozer blade B exerts upon the work being done. In this way, the cyclical loading and unloading of the spring 11 provides a power pulse which increases the efficiency of the bulldozer beyond that which the prior art would suggest. Accordingly. bulldozers having substantially less weight on the caterpillar type treads can out perform bulldozers having substantially greater weight.

In view of the foregoing it should be apparent that numerous structural modification are contemplated as being part of the invention as set forth hereinabove and as defined hereinbelow by the claims. For example, the cylinder/spring/shaft arrangement could be suitably replaced or substituted with various hydraulic or pneumatic devices for providing similar types of benefits.

I claim:

1. An improvement on a reciprocating bulldozer which includes a support arm carried on the bulldozer, a telescoping member slidably disposed within the support arm upon which telescoping member a bulldozer blade is provided, a cam disposed between the support arm and the telescoping member to provide horizontal oscillatory motion therebetween, the cam operatively connected to a power shaft having an output sprocket engaging a means for rotating the power shaft, the improvement comprising a cylindrical flywheel means disposed upon the power shaft spaced from the output sprocket and damping means extending between the telescoping member and the support arm whereby said flywheel means increases the vibratory action of the bulldozer blade and a portion of the energy associated with said flywheel means acts against said damping means wherein said damping means includes a supporting means carried on the support arm, a shaft fixedly and threadedly secured thereto, a cylinder disposed upon the telescoping member, a biasing means disposed within said cylinder, said shaft axially orientated with a bore in said cylinder acting against said biasing means wherein said shaft includes a terminus remote from said supporting means, a cap member having an annular sleeve frictionally disposed upon said shaft and a cap wall formed with said sleeve dimensioned substantially to the inner diameter of said cylinder and adapted to engage said biasing means in which said biasing means comprises a spring disposed within the bore of said cylinder and dimensioned substantially to the inner diameter of said cylinder in which said supporting means comprises an "L" shaped bracket having one leg extending outwardly provided with an aperture through which said shaft passes and another leg tangentially disposed and affixed to the support arm.

* * * * *